US006250406B1

(12) United States Patent
Luke

(10) Patent No.: US 6,250,406 B1
(45) Date of Patent: Jun. 26, 2001

(54) CONNECTION ARRANGEMENT FOR A TWO-PIECE ANNULAR BODY

(75) Inventor: Mike A. Luke, Houston, TX (US)

(73) Assignee: Weatherford/Lamb, Inc., Wilmington, DE (US)

( * ) Notice: Subject to any disclaimer, the term of this patent is extended or adjusted under 35 U.S.C. 154(b) by 0 days.

(21) Appl. No.: 09/483,338

(22) Filed: Jan. 14, 2000

(51) Int. Cl.[7] ..... E21B 17/10

(52) U.S. Cl. ..... 175/325.2; 175/325.7; 160/378

(58) Field of Search ..... 175/325.1, 325.2, 175/325.3, 325.6, 325.7

(56) References Cited

U.S. PATENT DOCUMENTS 2,860,013 * 11/1958 Medearis ..... 175/325.6
2,897,016 * 7/1959 Baker ..... 175/325.6
3,054,646 * 9/1962 Minor ..... 175/325.6
3,894,780 * 7/1975 Broussard ..... 175/325.6
4,266,578 * 5/1981 Swain et al. ..... 175/325.6 X
4,336,637 6/1982 Patterson .
4,796,670 * 1/1989 Russell et al. ..... 175/325.6 X
5,409,280 4/1995 Hill .
5,901,798 5/1999 Herrera et al. .

* cited by examiner

*Primary Examiner*—Frank Tsay
(74) *Attorney, Agent, or Firm*—Thomason, Moser & Patterson, L.L.P.

(57) ABSTRACT

A drill pipe and casing protector comprises an annular body having two pieces with identical edges. A first edge includes at least two opposing formations longitudinally formed thereon whereby when one piece is inverted with respect to the either piece, the first edges mate to form a pivotable connection allowing the body to be opened and closed about a pipe. The second edges of each piece include opposing interlocks which form an aperture along the second edge when the body is closed. The aperture receives a locking pin to retain the body in a closed position around a drill pipe as well as around a bushing assembly.

12 Claims, 11 Drawing Sheets

CONNECTION ARRANGEMENT FOR A TWO-PIECE ANNULAR BODY

BACKGROUND OF THE INVENTION

1. Field of the Invention

The present invention relates to a drill pipe and casing protector, and relates more particularly to a pivotable and lockable connection arrangement used with a protector for pipe and casing strings in the bore of a well.

2. Background of the Related Art

Pipe and casing protectors are well known. Their primary purpose is to prevent a string of drill pipe in a well from contacting the well bore or casing. In the drilling of oil and gas wells, a drill bit attached to the bottom of a drill string bores a hole into an underground formation. A drill string typically comprises a long string of connected tubular drill pipe sections that extend from the surface into a well bore formed by the drill bit on the bottom of the drill string. Casing is typically installed from the surface to various depths throughout the well bore to prevent the wall of the well bore from caving in and to prevent the transfer of fluids from various drilled formations from entering the well bore. The casing also provides a channel for recovering fluids if the well is productive. The terms "casing" and "well bore" will be used interchangeably herein.

During rotary drilling operations the drill pipe is subjected to radial and axial shock and abrasion whenever the moving drill pipe comes into contact with the wall of the well bore or the casing. In many drilling operations, the drill pipe may extend underground along a curved path, such as in deviated well drilling, and in these instances a considerable amount of torque can be produced by the effects of frictional forces developed between the rotating drill pipe and the casing or the wall of the well bore. Axial drag, brought about by contact between the pipe string and bore during the upwards and downwards movement of the pipe string is also a source of shock and abrasion.

In the past, drill pipe protectors have been placed in different locations along the length of a drill pipe to keep the drill pipe and its connections away from the walls of the casing. Typically, the protector comprises a generally annular body which surrounds but is free to rotate with respect to the drill pipe. Some prior art protectors are arranged and constructed to allow them to move freely in a longitudinal direction between the tool joints at the upper and lower ends of a pipe. Alternatively, annular retaining clamps may be applied to the pipe above and below the protector to restrict its range of longitudinal movement. The clamps may be positioned so as to locate the protector at a fixed position, or may be more widely spaced to allow longitudinal movement over a predetermined length of the pipe.

The outer diameter of the protector is greater than the maximum outer diameter of the joints connecting pieces of drill pipe and less than the inside diameter of the well bore or casing. The protector is preferably designed and constructed of materials that provide a relatively low coefficient of friction between the drill pipe and the inner surface of the protector and also between the outer surface of the protector and the bore or casing. In some cases, a bushing is affixed to the pipe and provides a low friction bearing surface upon which the inner surface of the annular body reacts. A number of protectors can be fitted to the pipe string and their location and number are typically determined by the relative likelihood contact between the pipe and casing wall in a particular well. Bidirectional wells for example, because of their non-linear path are particularly susceptible to pipe and casing wall contact both during rotation and during the insertion and removal of the drill string into the well. Protectors are therefore particularly useful in these wells.

In a typical arrangement, the protector body rotates with the drill pipe in the absence of contact between the protector and the casing. However, upon frictional contact between the body and the casing, the body stops rotating, or rotates very slowly, while allowing the drill pipe to continue rotating within the body unabated. This reduces rotational drag brought about by the contact between the rotating pipe string and the casing wall. Additionally, rollers are typically set into the body to reduce axial drag caused by the pipe moving up or down against the casing wall.

Improvements to protectors in recent years have included changes to the shape and configuration of the annular body and clamps, the use of bearing members on the internal and external surfaces of the annular body and between the body and the clamps or drill pipe joints, and materials for use in the fabrication of the body and bearings. In spite of recent improvements, some problems long associated with protectors still exist. For example, the protector, with its two piece annular body must be installed around a pipe which, in most cases already has a bushing and clamps installed around its perimeter. The installation of the annular body is accomplished by connecting the two pieces together at each side or at least at one side with pins, screws and bolts or plates and relying on a some type of hinge mechanism on the opposite side. This task can require special tools and extends the time that the well is not in operation.

There is a need therefore, for a pipe and casing protector that can be quickly and easily installed with a minimum of time and parts.

There is a further need for a protector which can be installed without the use of multiple fasteners and tools.

There is yet a further need for a protector which has a simple design making it easier to use and less expensive to manufacture.

SUMMARY OF THE INVENTION

The present invention generally provides a protector assembly that is quicker and easier to manufacture and install than those of the prior art. In one aspect of the invention, the protector includes an annular body with two pieces, each having identical edges. Male and female portions are formed along a first edge of each piece and opposing interlocks are formed along a second edge of each piece. When one piece is inverted with respect to the other piece, the male and female portions of the first edges mate to form a pivotable connection thereabout and the body can be closed around a pipe. As the body is closed, channels formed in each of the opposing interlocks align to form a longitudinal aperture constructed and arranged to receive a locking pin therethrough, thereby preventing the body from opening.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
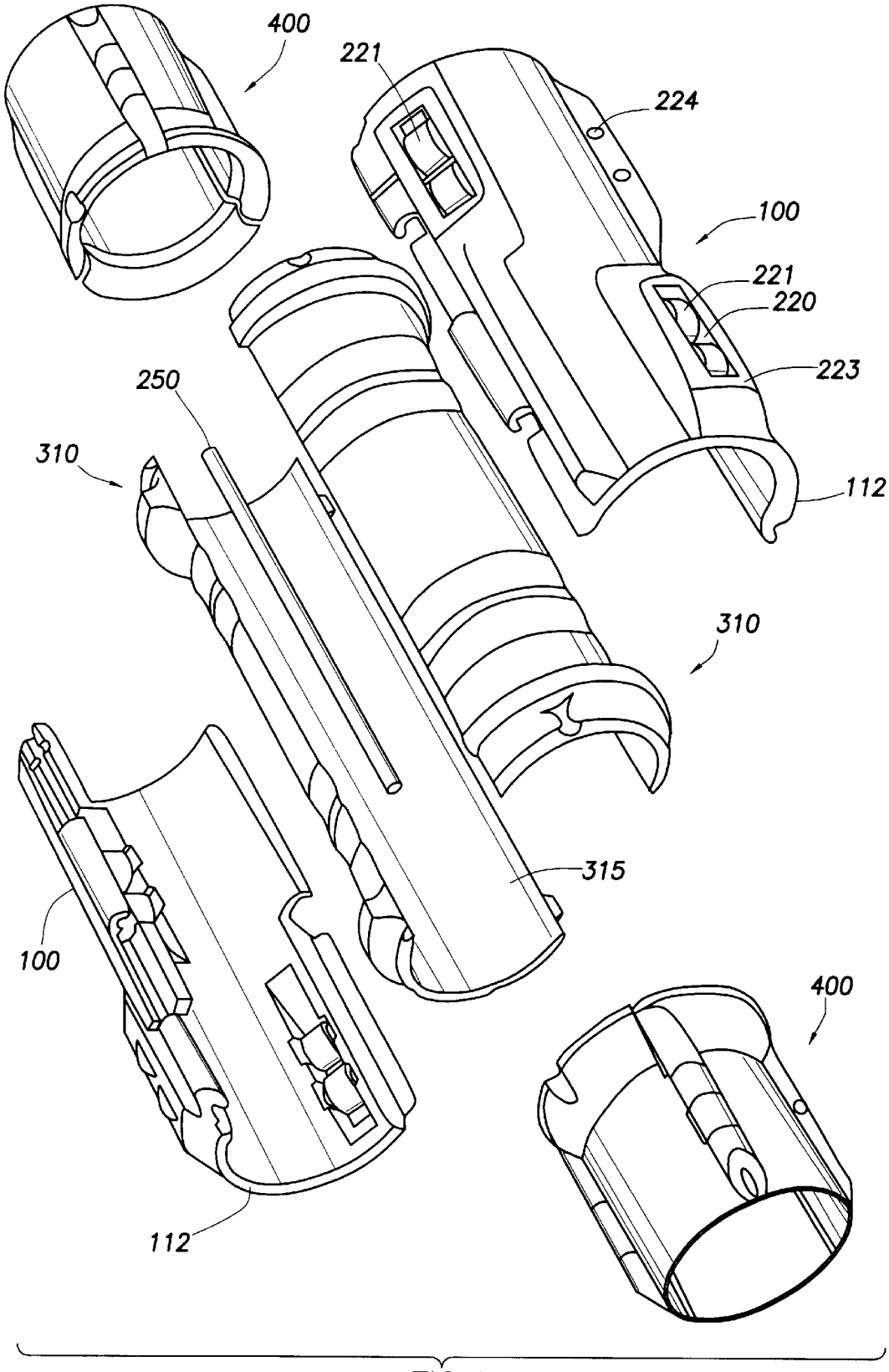
FIG. 1 is an exploded view showing the various pieces of a pipe and casing protector having the connection means of the current invention.

FIG. 1 is an exploded view of various pieces of a pipe and casing protector assembly having the connection arrangement of the present invention. The assembly includes an annular body made up of two identical pieces 100, a bushing assembly made up of two identical pieces 310, locking pin 250 and two clamp assemblies 400.

Considering the components in greater detail, formed in each piece 100 are three bearing apertures 220, each constructed and arranged to receive a pair of rollers 221 that aid the axial movement of the protector as it travels up and down in a casing or wellbore. More specifically, the rollers 221 interact with the casing wall to reduce axial drag between the pipe and the casing. A boss 223 is formed around each aperture 220 and each pair of rollers 221 are housed within boss 223 on axles (not shown) mounted through apertures 224 extending through each boss 223. Each piece 100 also includes a tapered lip 112 formed at each end thereof to interact with clamp assembly 400 as will be described herein.

Figure 2:
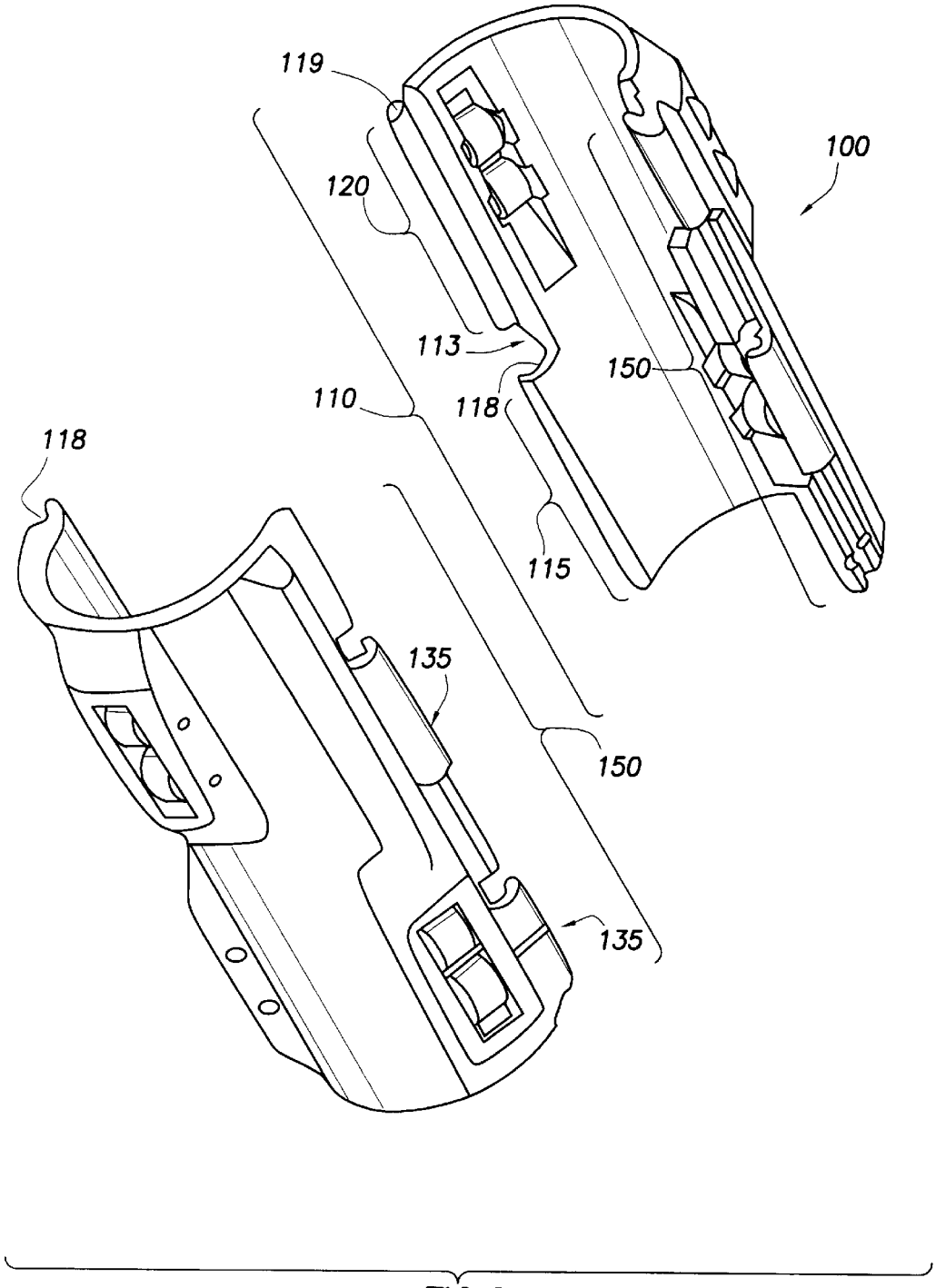
FIG. 2 is a perspective view showing the two-piece annular body.

FIG. 2 is a perspective view of the two-piece annular body. The pieces 100 of the body are identical and are designed to be connected together along their edges 110 when one piece is held in an inverted position relative to the other piece, as they are depicted in FIG. 2. Specifically, a pivotable connection is formed along first edge 110 of each piece and a locking connection is formed along second edge 150 of each piece.

Figure 4:
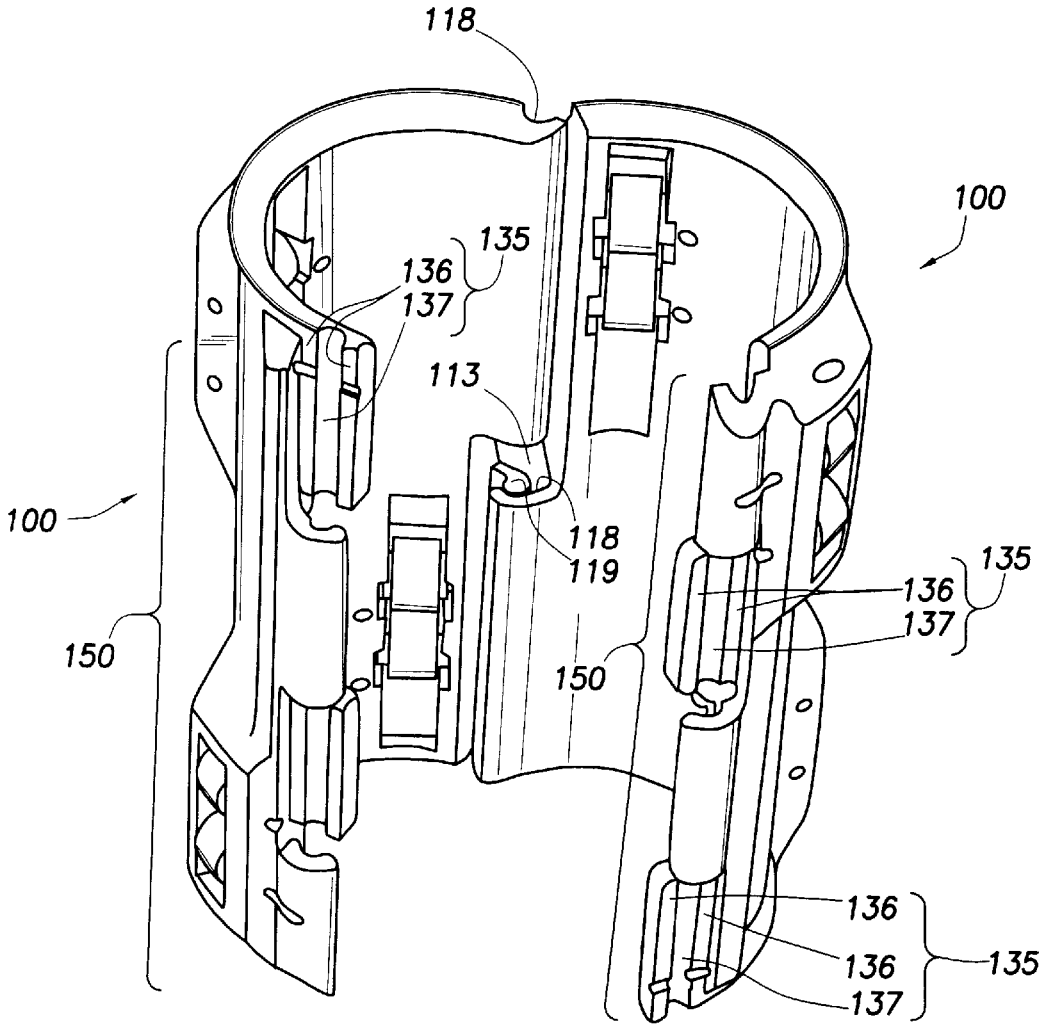
FIG. 4 is a perspective view showing the partially assembled two-piece annular body from the inside.

In a preferred embodiment, first edge 110 of each piece 100 includes one female portion 115 and one male portion 120. Female portion 115 has an outwardly directed, radiused channel 118 formed thereon. Male portion 120 includes an inwardly directed, radiused finger 119 formed thereon. Radiused channel 118 and radiused finger 119 are also visible in FIG. 8. An assembly clearance 113 is formed along edge 110 between portions 115 and 120. The opposite edge 150 of each piece 100 includes a number of opposing interlocks 135 aligned along the edge 150, as best seen in FIG. 4. In the preferred embodiment, each interlock 135 includes two planar surfaces 136 formed on each side of a longitudinal, semi-hemispherical channel 137 formed therebetween.

Figure 3:
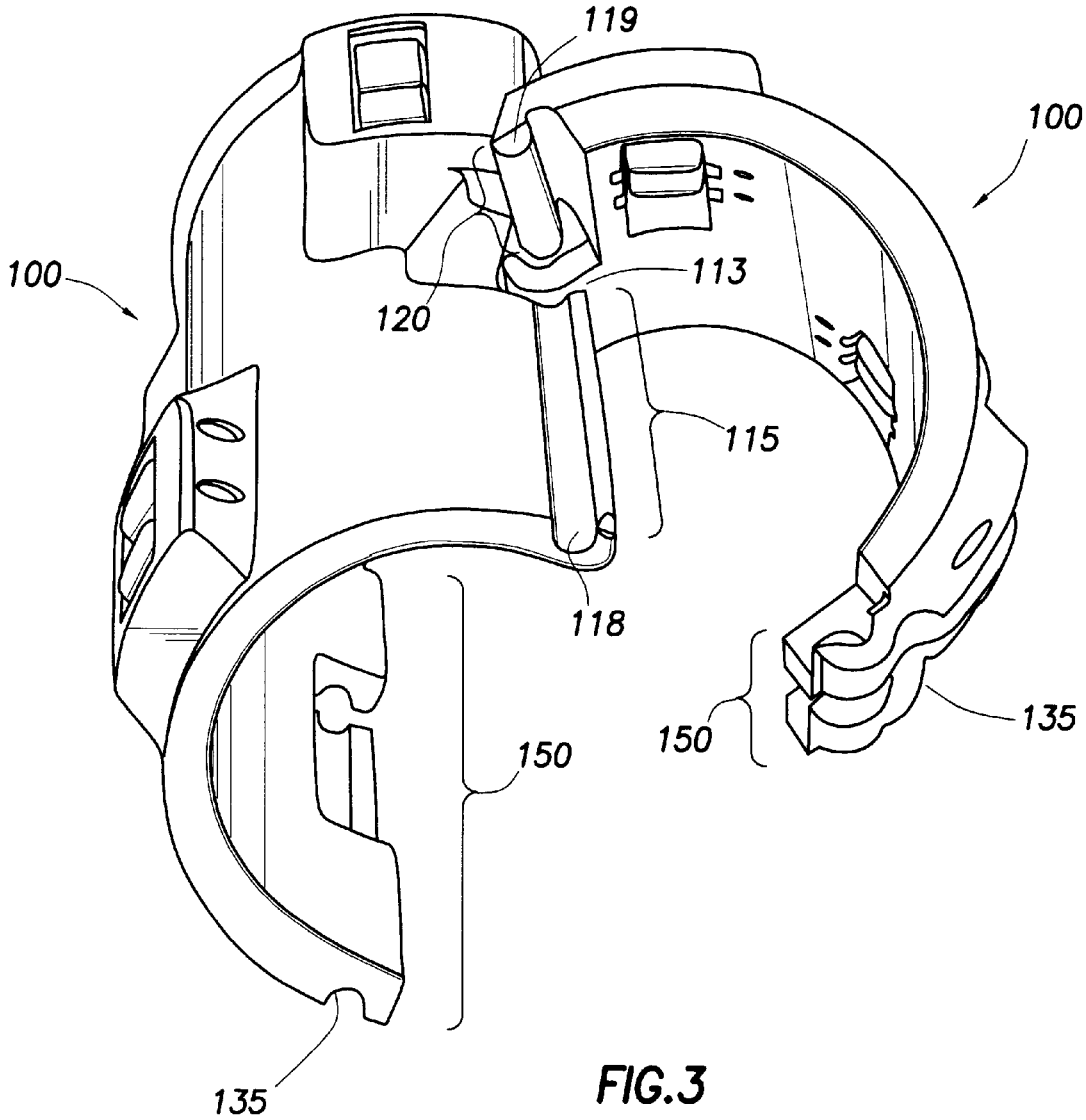
FIG. 3 is a perspective view showing the position of the pieces as they are assembled together.

FIG. 3 depicts the two pieces 100 of the annular body and the relative position of each as they are assembled together. In order to form the pivotal connection along edges 110, the two pieces 100 are rotated away from each other about a horizontal axis. FIG. 3 shows the pieces in such a relationship. With the assembly gaps 113 intersected as shown in FIG. 3, the pieces may be righted, causing radiused finger portion 119 of male portion 120 to be housed within the radiused channel 118 of female portion 115. Once assembled, the pieces will pivot about the axis formed along finger 119 between an open and closed position.

FIG. 4 is a perspective view showing both annular body pieces 100 as they appear after having been connected together along their edges 110. FIG. 4 depicts the body from the rear of the pivotal connection along edge 110. Visible in FIG. 4 is assembly gap 113, the inwardly directed radiused finger 119 of male portion 120 and outwardly directed radiused channel 118 of female portion 115. Also visible in FIG. 4 are edges 150 with their opposing interlocks 135 which will form the locking connection around the drill pipe. As the body, which is pivotally connected about finger 119 along edges 110 is closed, inwardly and outwardly facing interlocks 135 align and the semi-hemispherical channels 137 formed in each interlock form an aperture 175 (not visible in FIG. 4) running the length of the edge 150. Locking pin 250 (not shown) can then be inserted through the aperture locking the pieces together and preventing them from pivoting away from a closed position.

Figure 5:
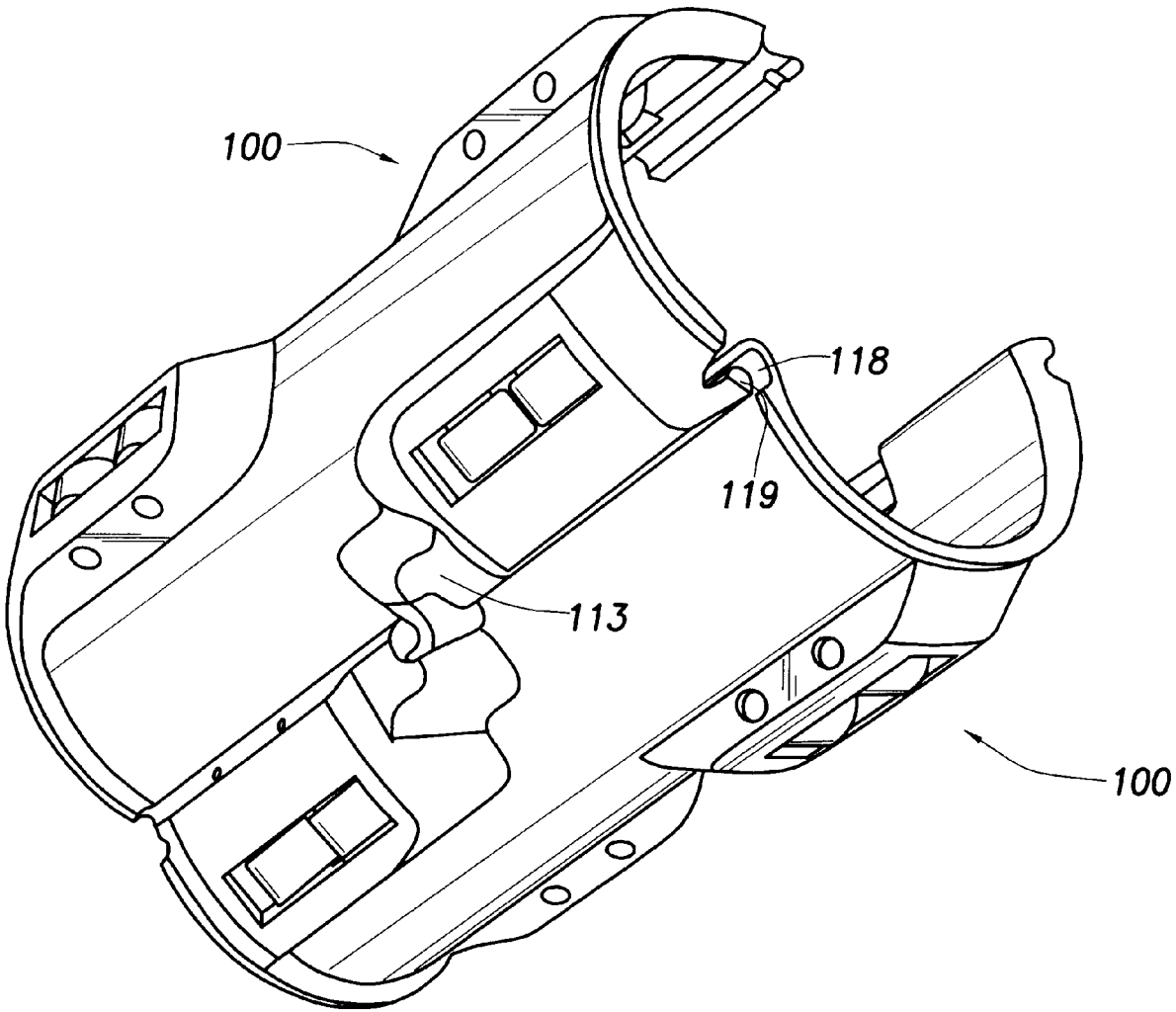
FIG. 5 is a perspective view showing the partially assembled two-piece annular body from the outside.

FIG. 5 is another perspective view showing the two pieces 100 of the annular body from the front of the pivotable connection about finger 119, along edges 110. Visible in the Figure are radiused channel 118 of the female portion 115 and inwardly directed, radiused finger 119 of male portion 120.

Figure 6:
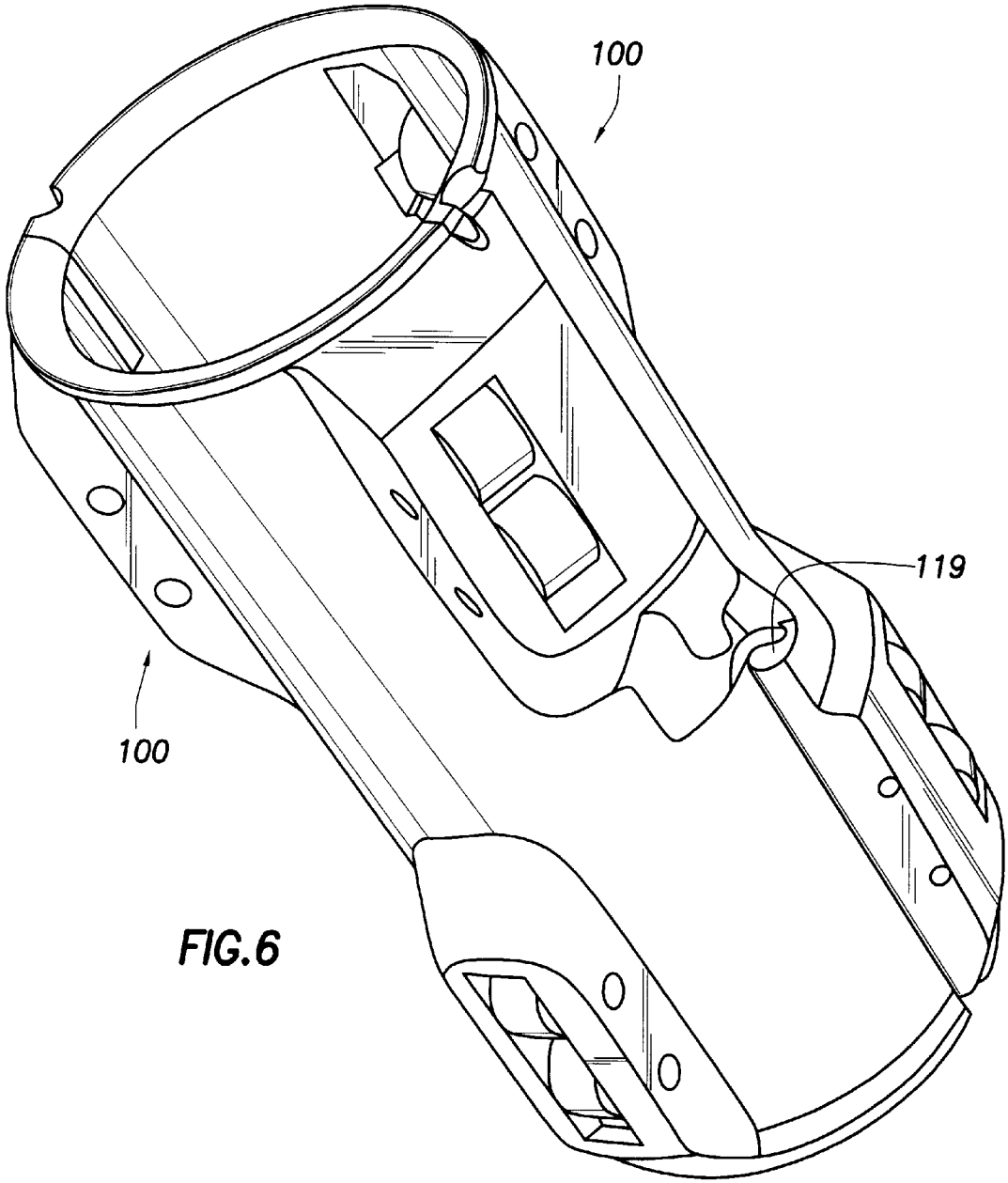
FIG. 6 is a perspective view showing the assembled, two piece annular body from the side of the pivotal connection.
Figure 7:
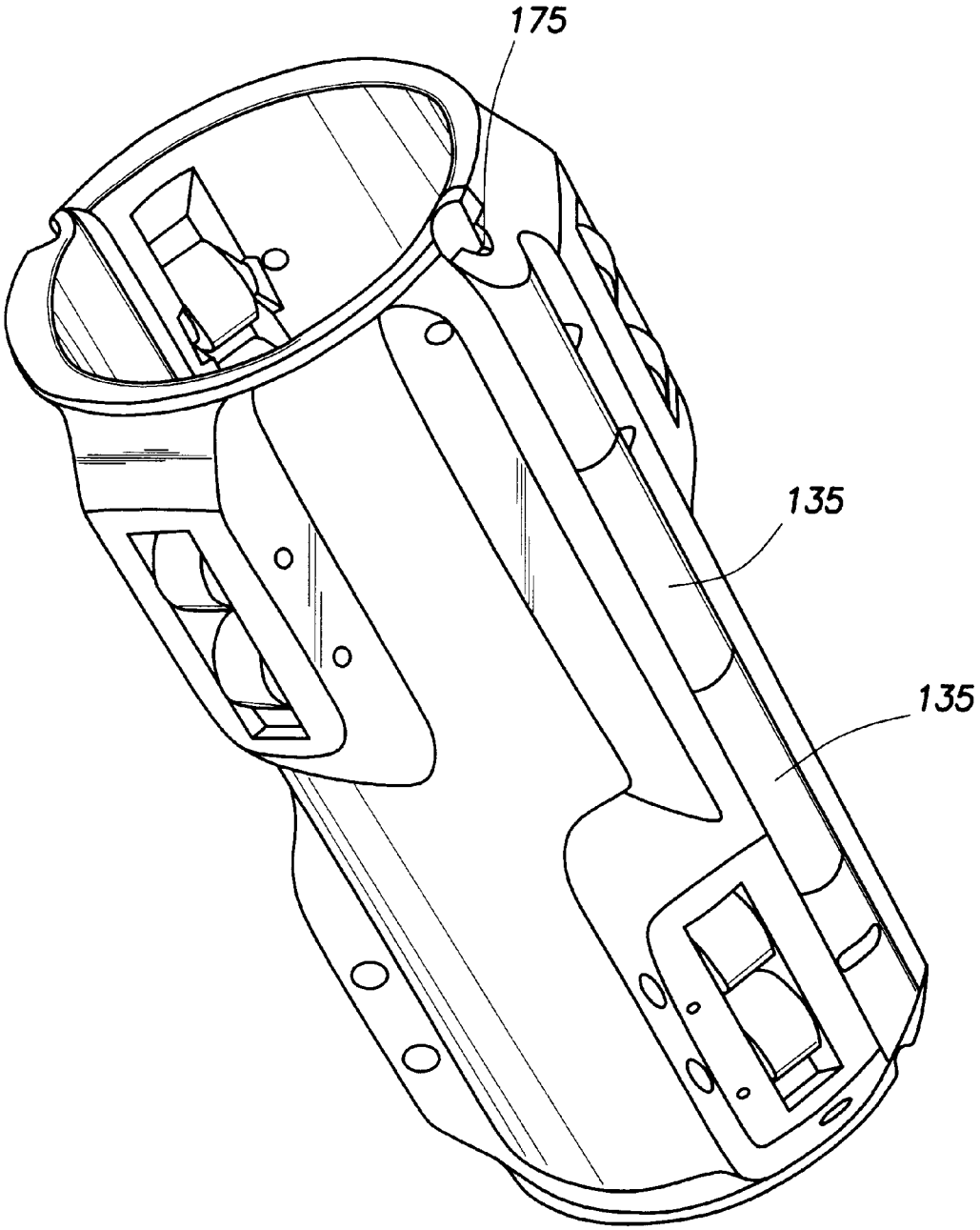
FIG. 7 is a perspective view showing the assembled, two piece annular body from the side of the locking connection.

FIG. 6 is a perspective view of the two piece annular body in an assembled state. Visible in FIG. 6 is that side of the annular body including edges 110 forming the pivotal connection between the two pieces 100 of annular body about finger 119. FIG. 7 is another perspective view of the assembled, two piece annular body as seen from the side opposite the pivoting side and wherein the opposing interlocks 135 of each edge 150 are seen in an intersected relationship. Aperture 175, formed by the semi-hemispherical channels 137 formed in each interlock 135, is visible at the top of the annular body. The locking pin 250 is not installed.

Figure 8:
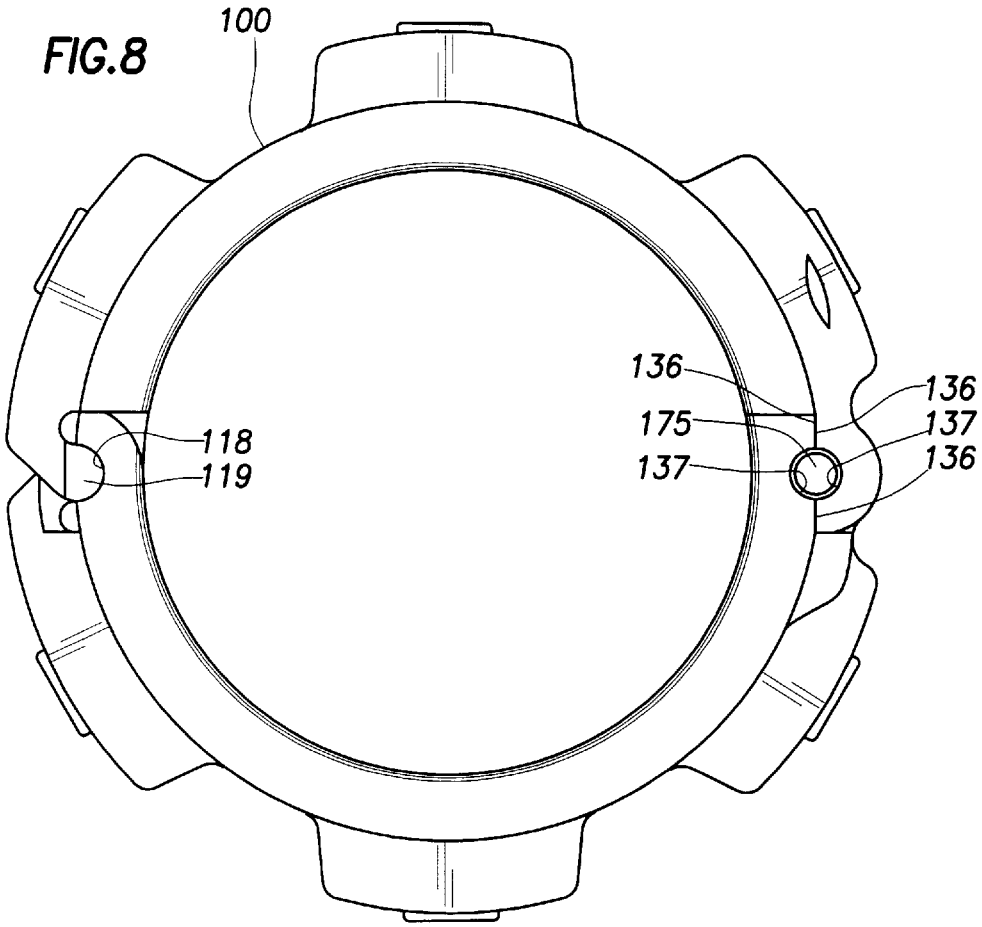
FIG. 8 is a top view showing the assembled two-piece annular body.

FIG. 8 is a top view of the two piece annular body showing the relationship of both assembled body halves 100 as they appear from above. At the connection depicted at the left side of FIG. 8, edges 110 of each piece are mated with the radiused channel 118 of female portion 115 housing the inwardly directed, radiused finger 119 of male portion 120. On the right side of the assembly, the lockable connection formed by the opposing interlocks about edges 150 is visible. Visible specifically are two of the semi-hemispherical surfaces 137 and four planar surfaces 136, that form aperture 175. While not depicted in FIG. 8, locking pin 250 may be inserted to prevent the annular body from opening at edges 150 and pivoting around the connection formed along edge 110.

In a preferred embodiment, a bushing assembly is disposed between the two-piece annular body and drilling pipe.

Figure 9:
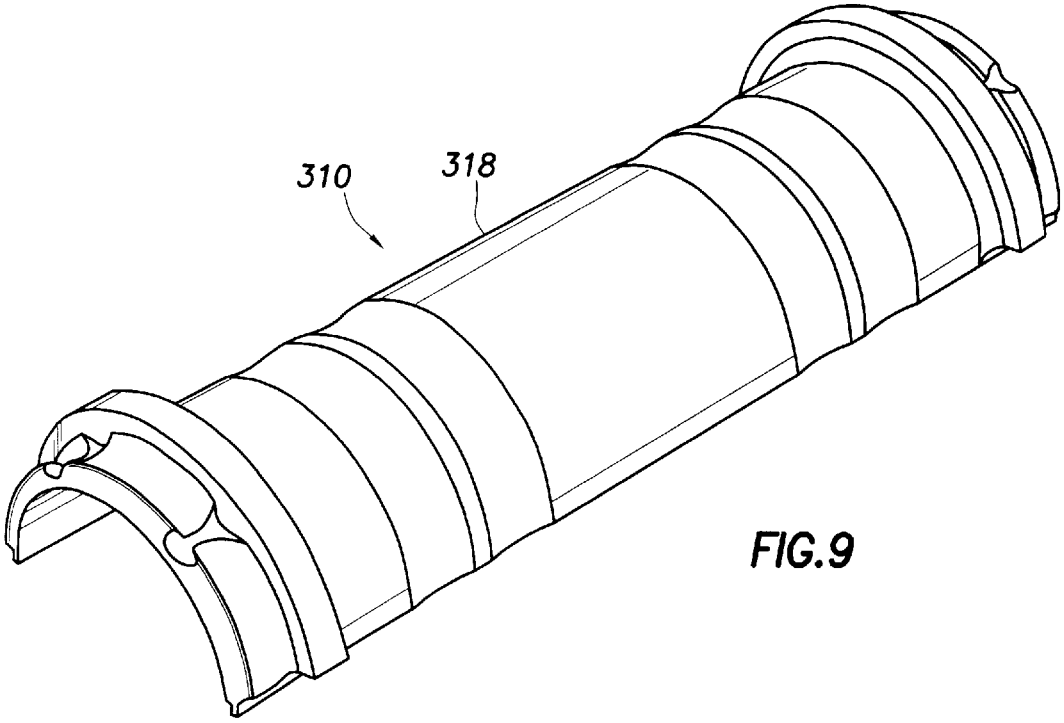
FIG. 9 is a perspective view of one side of the two-piece bushing assembly, the other side being identical thereto.

FIG. 9 shows one piece 310 of the two-piece bushing assembly. The other piece of the bushing assembly is identical to the piece 310 in FIG. 9 and both pieces are visible in FIG. 1. As can be appreciated in FIG. 1, the interior 315 of the bushing assembly is formed to smoothly fit the outside diameter of a drilling pipe. As visible in FIG. 9, the exterior surface 318 of the bushing assembly is constructed to be disposed within the two piece annular body and to rotate independently thereof. The materials of the annular body and the bushing assembly are selected from those materials that offer the best wear characteristics as well as the lowest coefficient of friction between the moving parts. In the preferred embodiment, the body is constructed of high strength steel while the bushing is made of a high performance polymer material. Those skilled in the art will appreciate that a wide selection of individuals are available depending upon the needs of a customer and conditions of a particular well and the materials selected to manufacture the various parts of the assembly described herein can vary widely and remain within the scope of the invention and the claims of the patent.

Figure 10:
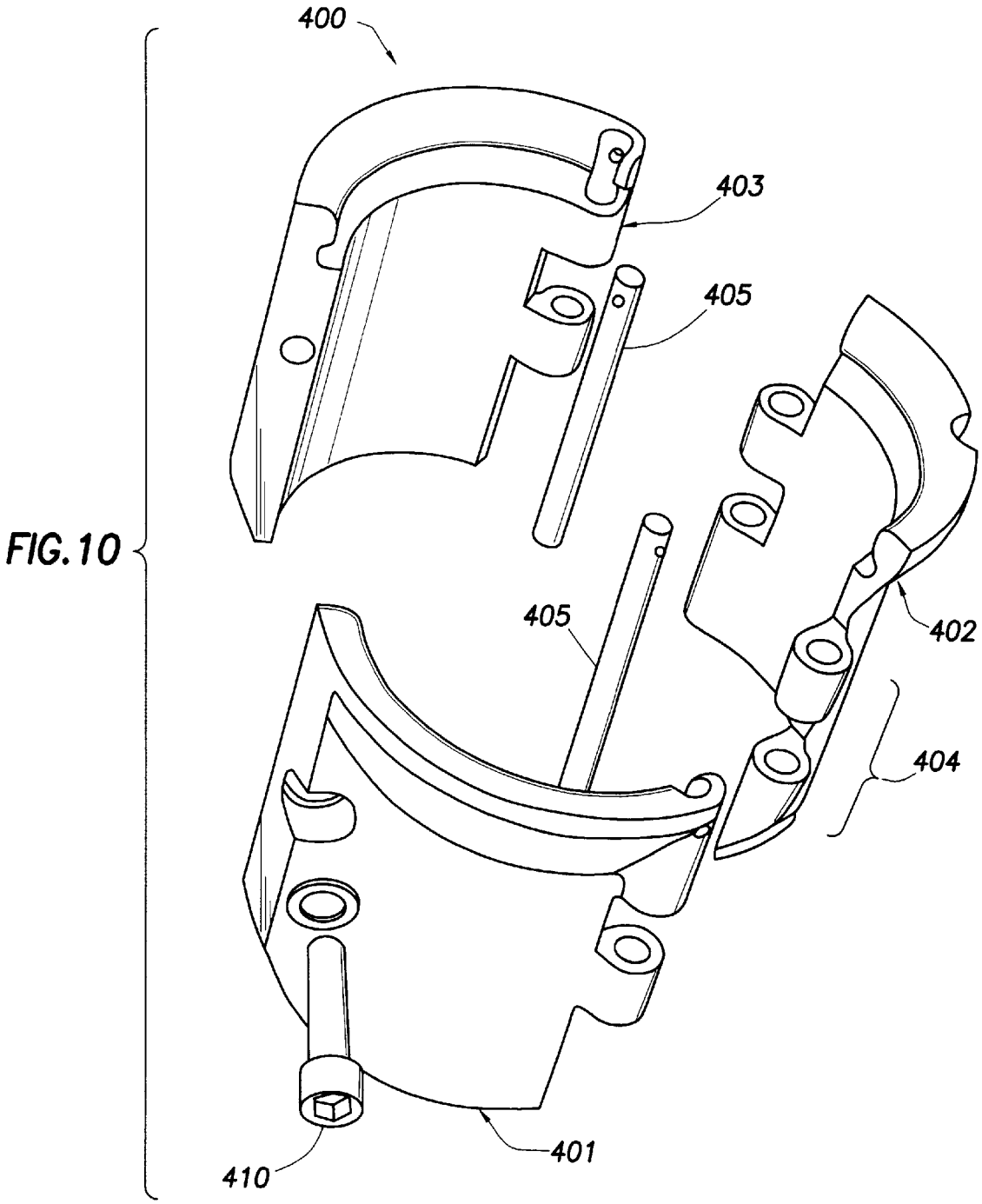
FIG. 10 is an exploded view showing a three piece clamp assembly.

FIG. 10 is an exploded view of a three piece clamp assembly 400 which is constructed and arranged to be assembled over drill pipe and the bushing assembly to hold the bushing assembly tight against the drill pipe and prevent its longitudinal or rotational movement with respect to the drill pipe. In the embodiment shown in FIG. 10, the clamp assembly consists of three pieces 401, 402, 403, each having a castellated hinge 404 on at least one edge for interlocking that piece with the next piece of the clamp assembly 400. Pins 405 act to hold the hinges together and a tightening screw 410 is provided to tighten the clamp assembly to a required torque around the bushing assembly and the pipe.

Figure 11:
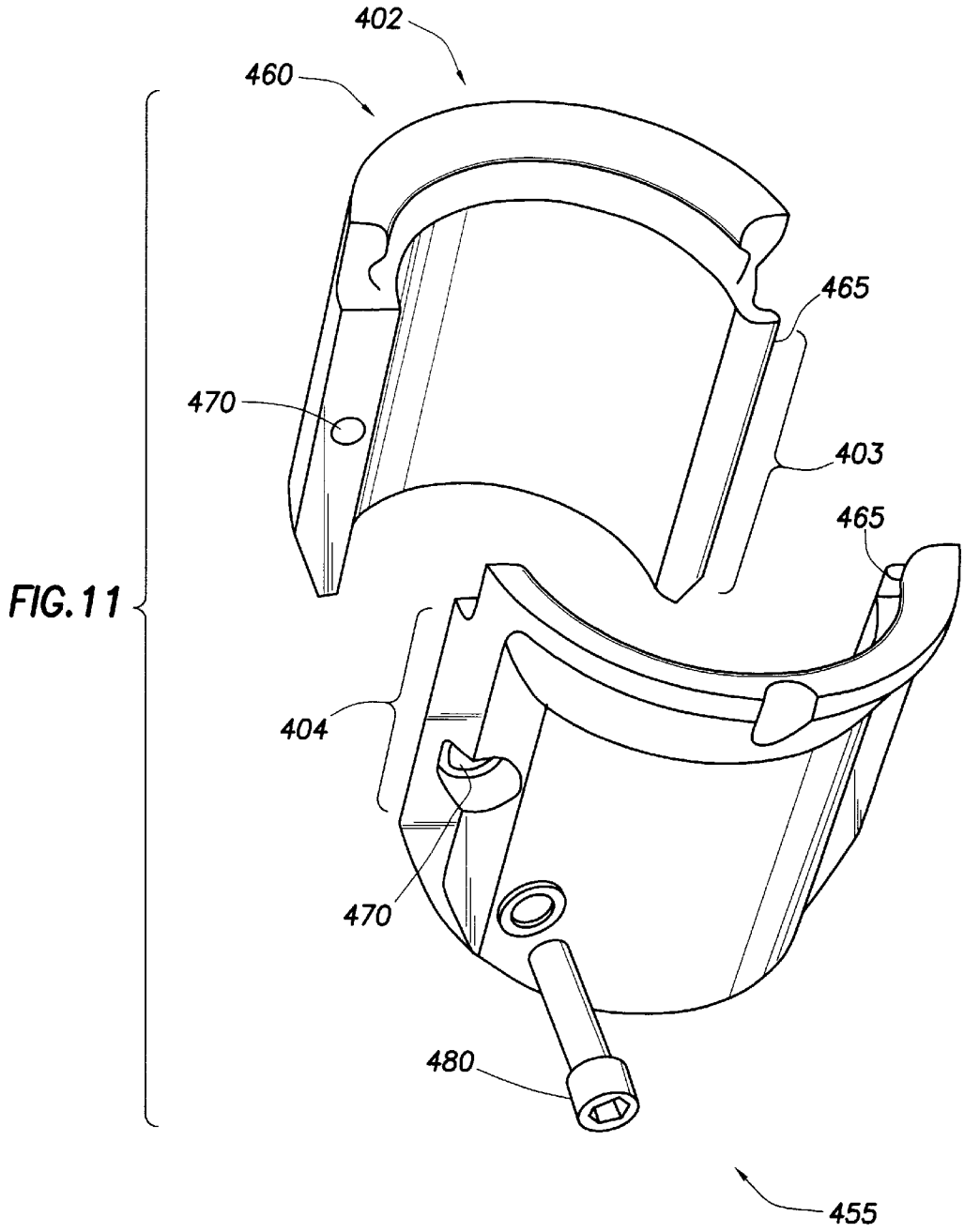
FIG. 11 is an exploded view showing a two-piece clamp assembly.

FIG. 11 is an alternative embodiment of a clamp assembly 402 and includes two pieces 455, 460 each of which has a tongue 465 formed along an edge 403 thereof and providing a hinge between the two pieces when they are fitted together. The opposite edge 404 of each piece includes an aperture 470, the apertures aligning when the pieces are assembled together and closed. A locking pin 480 is used to lock and tighten the clamp around the bushing assembly and drill pipe.

Figure 12:
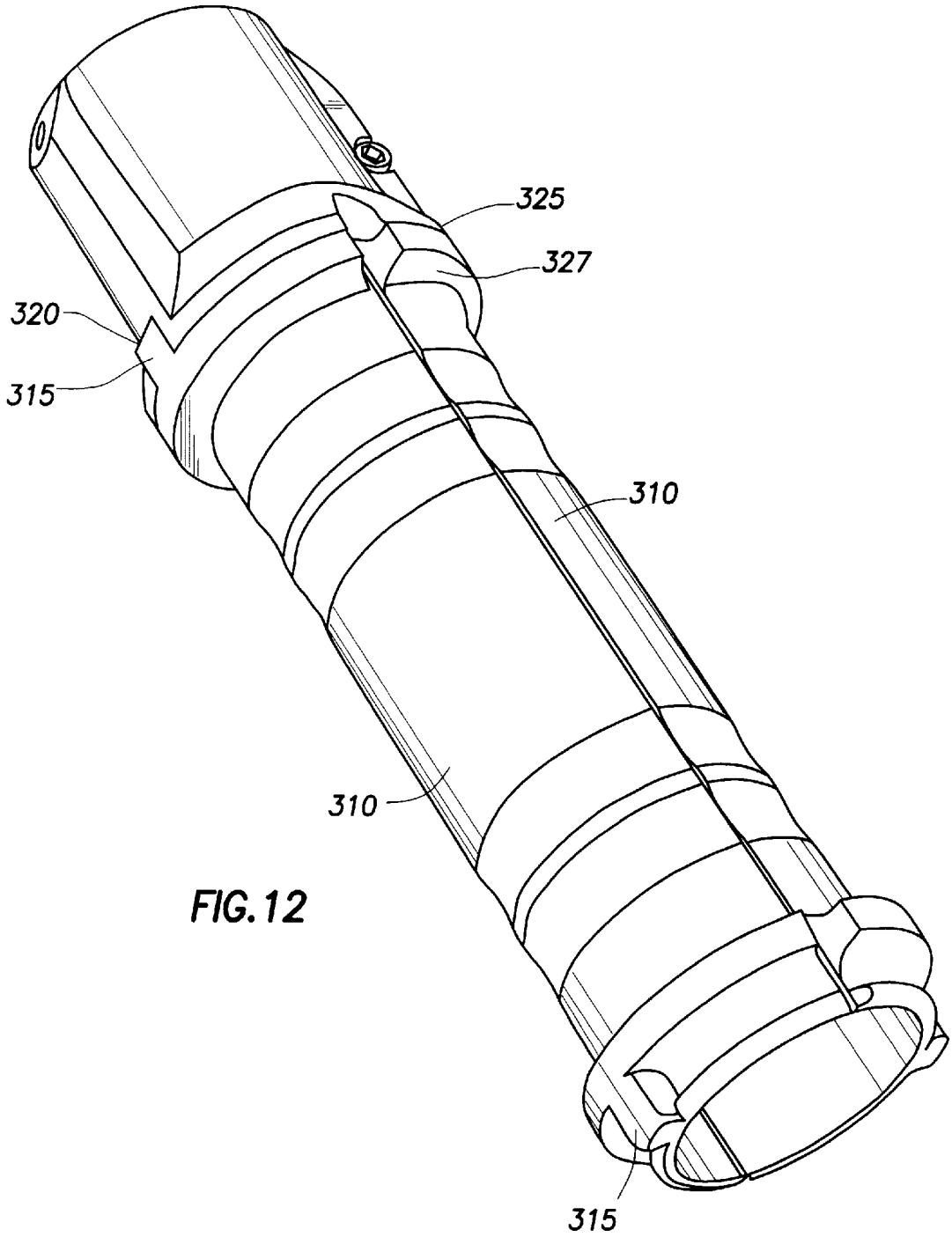
FIG. 12 is a perspective view showing the assembled clamp and bushing assembly.

FIG. 12 shows the arrangement by which the two-piece clamp assembly 402 is closed over the two piece bushing assembly to prevent the bushing assembly from rotating or moving longitudinally with respect to the drilling pipe. Specifically, a boss 315 formed on each end of the two piece bushing assembly is received into a mating cutout 320 formed at a first end of the assembled clamp 402. A groove 325 formed around the perimeter of each end of the bushing assembly interacts with a mating formation in a first end of the clamp assembly. When the two pieces 100 of the annular body are assembled over the clamp/bushing assembly, lip 112 formed at each end of the pieces 100 fits against shoulder 327 formed at each end of the bushing assembly.

As described in the foregoing, in a preferred embodiment, the two piece annular body is made up of two identical pieces 100 which fit together when one is held in an inverted position relative to the other, to form a pivotable connection about a first edge of each piece 100. The body can then be closed along an opposite edge 150 forming an aperture 175 into which a locking pin 250 may be inserted to lock the edges 150 and ensure the two piece annular body remains in a closed position on a drill pipe. As can be appreciated in FIG. 4, when the pieces 100 are joined along the leading edge 110, the partially assembled body can then be easily placed longitudinally over a piece of drilling pipe prior to being closed about edges 150 and locked shut over a bushing assembly along edges 150 with pin 250.

While foregoing is directed to the preferred embodiment of the present invention, other and further embodiments of the invention may be devised without departing from the basic scope thereof, and the scope thereof is determined by the claims that follow.

What is claimed is:

1. A connection system for a downhole tubular protective drill pipe and casing protector comprising:

an annular body having a first and second semi-cylindrical pieces;

a first edge formed on each of the pieces, the first edge having at least two opposing formations longitudinally formed thereon; whereby when one piece is inverted with respect to the other piece, the opposing formations form a pivotable connection along the first edges, the pivotable connection allowing the body to be pivoted between an open and closed position about a drill pipe.

2. The connection system of claim 1, wherein the opposing formations include one outwardly facing groove and one inwardly facing finger, separated along the first edge by a gap, the gap constructed and arranged to facilitate the pivotable connection along the first edges.

3. The connection system of claim 1, further including a second edge formed on each of the pieces, the second edge including a plurality of opposing interlocks longitudinally formed thereon whereby;

when said body is in the closed position, the interlocks mate to form a lockable connection along the second edges.

4. The connection system of claim 3, wherein the opposing interlocks include a semi-cylindrical channel formed, between two planar surfaces, the channels constructed and arranged to form an aperture along the second edges when the body is in the closed position.

5. The connection system of claim 4, whereby a pin is receivable in the aperture thereby retaining the body in the closed position.

6. The connection system of claim 1, further including a bushing assembly for disposition between the annular body and the drill pipe, the bushing assembly having a first and second semi-hemispherical pieces constructed and arranged to fit around the drill pipe.

7. The connection system of claim 6, further comprising two clamp assemblies for disposition at each end of the housing assembly, the clamp assemblies preventing rotational and axial movement of the bushing assembly with respect to the drill pipe.

8. The connection system of claim 7, wherein the clamp assemblies further prevent axial movement of the body about the drill pipe.

9. The connection system of claim 8, wherein the body rotates freely with respect to the drill pipe.

10. A method for installing a two piece, annular drill pipe protector on a pipe comprising the steps of:

inverting a first piece of the body with respect to the second piece;

connecting the two pieces together along a first edge of each piece to form a pivotable connection therebetween;

pivoting the connected pieces to a closed position around a pipe; and installing a locking pin in an aperture formed along a second edge of each piece to lock the body in a closed position.

11. A method for installing a drill pipe protector on a pipe string comprising the steps of:

placing a two piece bushing assembly around a drill pipe;

installing a clamp at each end of the bushing assembly;

inverting a first piece of a two piece annular protector body with respect to the second piece;

connecting the two pieces together along a first edge of each piece to form a pivotable connection therebetween;

pivoting the connected pieces to a closed position around the two piece bushing assembly; and installing locking pin in an aperture formed along a second edge of each piece to lock the body in a closed position.

12. A connection system for a downhole tubular protector comprising:

an annular body having a first and second semi-cylindrical pieces;

a first edge formed on each of the pieces, the first edge having at least two opposing formations longitudinally formed thereon; whereby when one piece is inverted with respect to the other piece, the opposing formations form a pivotable connection along the first edges, the pivotable connection allowing the body to be pivoted between an open and closed position about a drill pipe.

* * * * *